US010718329B2

(12) United States Patent
Nakano et al.

(10) Patent No.: US 10,718,329 B2
(45) Date of Patent: Jul. 21, 2020

(54) SCROLL COMPRESSOR

(71) Applicant: Hitachi-Johnson Controls Air Conditioning, Inc., Tokyo (JP)

(72) Inventors: Yasunori Nakano, Tokyo (JP); Satoshi Nakamura, Tokyo (JP); Takamasa Adachi, Tokyo (JP); Masatsugu Chikano, Tokyo (JP); Yuuichi Yanagase, Tokyo (JP)

(73) Assignee: HITACHI-JOHNSON CONTROLS AIR CONDITIONG, INC., Tokyo (JP)

( * ) Notice: Subject to any disclaimer, the term of this patent is extended or adjusted under 35 U.S.C. 154(b) by 156 days.

(21) Appl. No.: 15/574,534

(22) PCT Filed: May 13, 2016

(86) PCT No.: PCT/IB2016/052759
§ 371 (c)(1),
(2) Date: Nov. 16, 2017

(87) PCT Pub. No.: WO2016/185336
PCT Pub. Date: Nov. 24, 2016

(65) Prior Publication Data

US 2018/0128269 A1 May 10, 2018

(30) Foreign Application Priority Data

May 19, 2015 (JP) ..... 2015-101619

(51) Int. Cl.
*F04C 27/00* (2006.01)
*F04C 18/02* (2006.01)
(Continued)

(52) U.S. Cl.
CPC ..... *F04C 18/0223* (2013.01); *F01C 21/02* (2013.01); *F01C 21/104* (2013.01);
(Continued)

(58) Field of Classification Search
CPC ..... F04C 18/0223; F04C 18/0215; F04C 27/008; F04C 29/028; F04C 27/001;
(Continued)

(56) References Cited

U.S. PATENT DOCUMENTS 4,522,574 A 6/1985 Arai et al.
4,875,838 A 10/1989 Richardson, Jr.
(Continued)

FOREIGN PATENT DOCUMENTS

CN 1479013 A 3/2004
CN 201288666 Y 8/2009
(Continued)

OTHER PUBLICATIONS

Korean Office Action received in corresponding Korean Application No. 10-2017-7033194 dated Oct. 23, 2018.
(Continued)

*Primary Examiner* — Rick K Chang
(74) *Attorney, Agent, or Firm* — Mattingly & Malur, PC

(57) ABSTRACT

A scroll compressor is provided which includes: a revolving scroll, a fixed scroll, an autorotation preventing mechanism, a frame, a crank shaft provided with an eccentric pin portion which is eccentric with respect to an axis, the crank shaft being provided with a flange portion at a lower portion of the eccentric pin portion, the flange portion being larger than the diameter of the eccentric pin portion, a balance weight mounted on the flange portion, a sealing member performing sealing between the revolving scroll and the flange portion, and a thrust bearing arranged between the frame and the flange portion. The scroll compressor reduces the amount of oil flowing into a back pressure chamber, thereby improving the performance of the scroll compressor.

6 Claims, 7 Drawing Sheets

(51) Int. Cl.

| | |
|---|---|
| ***F01C 21/02*** | (2006.01) |
| ***F01C 21/10*** | (2006.01) |
| ***F04C 29/02*** | (2006.01) |

(52) U.S. Cl.
CPC ..... *F04C 18/0215* (2013.01); *F04C 27/001* (2013.01); *F04C 27/008* (2013.01); *F04C 29/021* (2013.01); *F04C 29/028* (2013.01); *F04C 2230/604* (2013.01); *F04C 2240/50* (2013.01); *F04C 2240/807* (2013.01)

(58) Field of Classification Search
CPC ..... F04C 29/021; F04C 2240/50; F04C 2240/807; F04C 2230/604; F01C 21/02; F01C 21/104
See application file for complete search history.

(56) References Cited

U.S. PATENT DOCUMENTS

| | | | | |
|---|---|---|---|---|
| 4,884,955 | A | 12/1989 | Richardson, Jr. | |
| 5,108,274 | A | 4/1992 | Kakuda et al. | |
| 5,137,437 | A | 8/1992 | Machida et al. | |
| 5,222,881 | A * | 6/1993 | Sano | F01C 21/02 418/55.1 |
| 5,695,326 | A * | 12/1997 | Oka | F04C 29/0021 384/912 |
| 2001/0048886 | A1 | 12/2001 | Kuroki et al. | |
| 2003/0147763 | A1 | 8/2003 | Sakuda et al. | |
| 2004/0042917 | A1 | 3/2004 | Chang et al. | |
| 2004/0219048 | A1 | 11/2004 | Tsuchiya et al. | |
| 2012/0230853 | A1 | 9/2012 | Yanagase et al. | |
| 2013/0302198 | A1 | 11/2013 | Ginies et al. | |

FOREIGN PATENT DOCUMENTS

| | | | |
|---|---|---|---|
| CN | 201687707 | U | 12/2010 |
| CN | 102562589 | A | 7/2012 |
| CN | 103415704 | A | 11/2013 |
| EP | 0 341 402 | A2 | 11/1989 |
| EP | 0 341 403 | A2 | 11/1989 |
| EP | 0992690 | A1 | 4/2000 |
| EP | 1275849 | A2 | 1/2003 |
| JP | 59-79086 | A | 5/1984 |
| JP | 02-264175 | A | 10/1990 |
| JP | 7-217555 | A | 8/1995 |
| JP | 2004-360504 | A | 12/2004 |
| JP | 2011-190779 | A | 9/2011 |
| JP | 2012-184743 | A | 9/2012 |
| KR | 2003-0066444 | A | 8/2003 |
| KR | 10-2005-0082634 | A | 8/2005 |

OTHER PUBLICATIONS

Japanese Office Action received in corresponding Japanese Application No. 2015-101619 dated Mar. 19, 2019.
Chinese Office Action received in corresponding Chinese Application No. 201680028271.5 dated Nov. 6, 2018.
Extended European Search Report received in corresponding European Application No. 16795971.7 dated Nov. 28, 2018.
International Search Report of PCT/IB2016/052759 dated Sep. 8, 2016.

* cited by examiner

SCROLL COMPRESSOR

TECHNICAL FIELD

The present invention relates to a scroll compressor.

BACKGROUND ART

For a conventional scroll compressor, presented is an art in which a first thrust bearing is provided between a counter weight (balance weight) and a movable scroll (a revolving scroll), and a second thrust bearing is provided between the counter weight (balance weight) and a housing (frame) (for example, refer to Patent Document 1).

RELATED ART DOCUMENT

Patent Document

Patent Document 1: Japanese Patent Application Laid-Open No. H2-264175

DISCLOSURE OF THE INVENTION

Problem to be Solved by the Invention

In a scroll compressor, a centrifugal force is caused on a crank shaft by the revolution movement of a revolving scroll, and a balance weight is fitted to the crank shaft to cancel imbalance caused by this centrifugal force. In general, at the closer position in the axial direction to the revolving scroll the balance weight is fitted, the lighter the balance weight can be arranged. Accordingly, the balance weight can be made light effectively by housing the balance weight inside a frame where the revolving scroll is housed.

Further, for oil supply to the sliding portions of a bearing, a scroll and the like, in a scroll compressor, a pump mechanism is fitted to the lower end portion of a crank shaft, and an oil supply hole is provided inside the crank shaft, penetrating along the axial direction. Oil supplied by this pump mechanism is supplied, inside the frame, to the respective sliding portions represented by a plain bearing (revolution bearing), a scroll portion, and the like.

However, in the art disclosed by Patent Document 1, as the load of the crank shaft is supported actively between the balance weight and the frame, sealing between the revolving scroll and the balance weight is weakened, and oil excessively flows into a back-pressure chamber. Consequently, in a case of housing a balance weight in the inside of a frame, there was a problem that the balance weight rotationally moves in the space excessively containing oil so that loss is caused by agitation of the oil, and thus the performance is decreased.

The present invention solves the above conventional problem, and an object of the invention is to provide a scroll compressor enabling improvement of the performance by reducing the amount of oil that flows into a back-pressure chamber.

Means for Solving the Problem

An aspect of the present invention provides a scroll compressor, including:

a crank shaft including an eccentric pin portion eccentric from an axial center;

a revolving scroll having a scroll shape on a bedplate and connected to the eccentric pin portion;

a fixed scroll having a scroll shape that engages with the scroll shape of the revolving scroll;

an autorotation preventing mechanism that prevents the revolving scroll from autorotating;

a frame that houses the revolving scroll and the autorotation preventing mechanism, rotatably supports the crank shaft with a bearing, and fixes the fixed scroll, wherein the crank shaft includes a flange portion having a larger diameter than a diameter of the eccentric pin portion and arranged at a lower portion of the eccentric pin portion;

a balance weight that is mounted on the flange portion to cancel imbalance caused by rotational movement of the eccentric pin portion and revolution movement of the revolving scroll;

a sealing member that provides sealing between the revolving scroll and the flange portion; and a thrust bearing provided between the frame and the flange portion.

Advantageous Effect of the Invention

According to the invention, it is possible to provide a scroll compressor enabling improvement of the performance by decreasing the amount of oil that flows into a back-pressure chamber.

EMBODIMENTS FOR CARRYING OUT THE INVENTION

Figure 1:
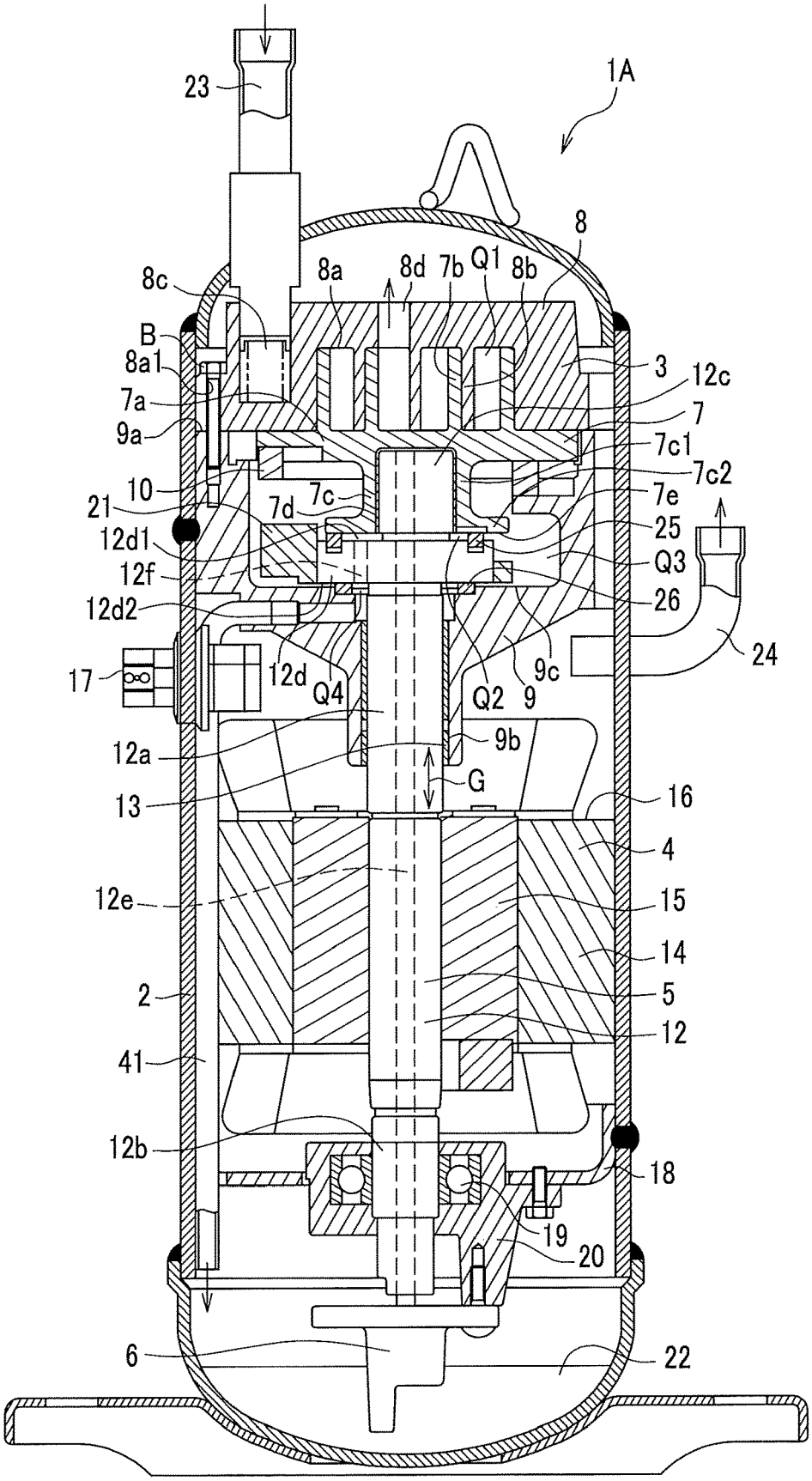
FIG. 1 is a vertical cross-sectional view showing the entire structure of a scroll compressor in a first embodiment.

In the following, embodiments for carrying out the present invention (hereinafter, referred to as 'embodiment') will be described in detail, referring to the drawings, as appropriate. In the following, a vertical type scroll compressor with a vertical axial direction (upper-lower direction) will be described as an example, however, the invention can also be applied to a horizontal type scroll compressor with a horizontal axis direction.

First Embodiment

FIG. 1 is a vertical cross-sectional view showing the entire structure of a scroll compressor in a first embodiment.

As shown in FIG. 1, the scroll compressor 1A in the first embodiment is structured by housing a compressing mechanism portion 3, a driving portion 4, a rotation shaft portion 5, and an oil supplying mechanism portion 6, in a airtight vessel 2.

The compressing mechanism portion 3 has a structure including a revolving scroll 7, a fixed scroll 8, a frame 9 and a autorotation preventing mechanism 10.

The revolving scroll 7 has a structure including a bedplate 7*a*, a revolving scroll body (revolving-side lap) 7*b*, a revolving scroll bearing portion 7*c*, and a plain bearing 7*d*.

The bedplate 7*a* is substantially in a circular disk shape, provided with the scroll body 7*b* on the upper surface (one side) and the revolving scroll bearing portion 7*c* on the lower surface (the other side). The revolving scroll body 7*b* has a scroll shape and stands vertically on the one side of the bedplate 7*a*. The revolving scroll bearing portion 7*c* is vertically protruding to the other side (the side opposite to the revolving scroll body 7*b*) of the bedplate 7*a*. The revolving scroll bearing portion 7*c* has a cylindrical portion 7*c*1 extending in the axial direction (the upper-lower direction in the figure) and an annular portion 7*c*2 protruding outward in the radial direction in a flange shape at the tip end (lower end) of the cylindrical portion 7*c*1. The plain bearing 7*d* is fitted to the inside of the cylindrical portion 7*c*1 by pressure-fitting or the like to support the revolving scroll 7 to be slidable with respect to a crank shaft 12.

The fixed scroll 8 has a structure including a bedplate 8*a*, a fixed scroll body (fixed side lap) 8*b*, a suctioning inlet 8*c*, and a discharging outlet 8*d*.

The bedplate 8*a* is substantially in a circular disc shape and is provided with a bolt insertion hole 8*a*1 fastened by the later-described frame 9 and a bolt B, at an outer circumferential marginal portion. The fixed scroll body 8*b* is in a scroll shape, vertically stands on one side of the bedplate 8*a*, and is disposed such as to face the revolving scroll body 7*b*. In such a manner, the fixed scroll body 8*b* and the revolving scroll body 7*b* form a compression chamber Q1. The suctioning inlet 8*c* is formed on the outer circumferential side of the bedplate 8*a* and communicates with the outer portion of the airtight vessel 2 through a suction tube 23. The discharging outlet 8*d* is formed such as to penetrate through the bedplate 8*a* at the center along the axial direction, and communicates with the compression chamber Q1 and the outer portion of the compressing mechanism portion 3 inside the airtight vessel 2.

The frame 9 has a structure including a fixed scroll fastening surface 9*a* that fastens the fixed scroll 8 by the bolt B, and a frame bearing portion 9*b* for housing a main bearing 13 (bearing) that rotatably supports the crank shaft 12.

The autorotation preventing mechanism 10 is housed in the frame 9 and is engaged with the bedplate 7*a*, on the side opposite to the revolving scroll body 7*b*, so that the revolving scroll 7 moves with revolving, without autorotation relative to the fixed scroll 8. Incidentally, the autorotation preventing mechanism 10 is structured by a known method.

The driving portion 4 has a structure including an electric motor 16 configured by a stator 14 and a rotor 15.

In the electric motor 16, the stator 14 is fixed to the inner wall surface of the airtight vessel 2, and the rotor 15 is fixed to the crank shaft 12. The electric motor 16 is driven by electrical input from a power source (not shown) through an electrical terminal 17 to apply a rotation force to the crank shaft 12.

The rotation shaft portion 5 has a structure including the crank shaft 12, the main bearing 13, a sub-frame 18, a sub-bearing (rolling bearing) 19, a sub-bearing housing 20, and a balance weight 21.

The crank shaft 12 has a structure including a main shaft portion 12*a*, a sub-shaft portion 12*b*, an eccentric pin portion 12*c*, a flange portion 12*d*, and a penetration hole 12*e*.

The main shaft portion 12*a* is rotatably supported by the main bearing 13. The sub-shaft portion 12*b* is rotatably supported by the sub-bearing 19. The crank shaft 12 is connected with the rotor 15, between the main shaft portion 12*a* and the sub-shaft portion 12*b*.

The eccentric pin portion 12*c* is arranged at the upper end (one end) of the main shaft portion 12*a* (crank shaft 12) such that the axis center of the eccentric pin portion 12*c* is eccentric from the axis center of the main shaft portion 12*a*. The eccentric pin portion 12*c* is engaged with the revolving scroll 7 through the plain bearing 7*d*.

The flange portion 12*d* is formed at the lower portion of the eccentric pin portion 12*c* and has a diameter larger than those of the eccentric pin portion 12*c* and the main shaft portion 12*a*. Further, the axis center of the flange portion 12*d* and the center of the main shaft portion 12*a* agree with each other.

The flange portion 12*d* is structured integrally with the eccentric pin portion 12*c* and the main shaft portion 12*a*. Herein, the integral structure refers to a structure obtained, for example, in such a manner that the crank shaft 12 is formed by cutting a single metal cylindrical material (ingot). In such a manner, the flange portion 12*d* is formed in a direction perpendicular to the axial direction G of the crank shaft 12, in other words, formed with high precision such that the upper surface 12*d*1 and the lower surface 12*d*2 of the flange portion 12*d* are perpendicular to the axial direction G (formed with precise perpendicularity).

The flange portion 12*d* is provided with an oil passage 12*f* for communication between a high-pressure space Q2 between the upper surface 12*d*1 of the flange portion 12*d* and the revolving scroll 7 and a high-pressure space Q4 between the lower surface 12*d*2 of the flange portion 12*d* and the frame 9. The oil passage 12*f* communicates with oil accumulation 22 in the airtight vessel 2 through a pipe 41.

The main bearing 13 is arranged by a plain bearing and fitted to the frame bearing portion 9*b* by press fitting or the like. The sub-frame 18 is arranged on the side opposite to the compressing mechanism portion 3 in the axial direction G of the crank shaft 12 across the electric motor 16. The sub-frame 18 is fixed to the airtight vessel 2 by plug welding. The sub-bearing 19 is arranged in the sub-bearing housing 20 fixed to the sub-frame 18. Incidentally, the sub-frame 18 and the sub-bearing housing 20 may be integrally structured.

The balance weight 21 is fitted to the flange portion 12*d* of the crank shaft 12 to have action in the direction where the balance weight 21 cancels imbalance caused by the revolution movement of the revolving scroll 7. Further, the balance weight 21 is fitted such as to protrude toward the outer circumferential side of the flange portion 12*d*. Still further, the balance weight 21 is fitted to the flange portion 12*d* by press fitting or the like.

At the lower portion of the airtight vessel 2, the oil supplying mechanism portion 6 is engaged with the lower end of the crank shaft 12. Using the rotation of the crank shaft 12, the oil supplying mechanism portion 6 suctions up oil from the oil accumulation 22 at the lower portion of the airtight vessel 2. The oil supplying mechanism portion 6 supplies the oil, through the penetration hole 12*e* formed through the crank shaft 12, to respective sliding portions of the compressing mechanism portion 3. As fuel supplying means, in general, a centrifugal pump or a volume variable pump is used.

The scroll compressor 1A with such a structure operates as follows. By the rotation of the crank shaft 12 driven by the electric motor 16, the revolving scroll 7 moves with revolution. This provides a compression operation by decreasing the volume of the compression chamber Q1 which is mechanically structured by engagement between the revolving scroll body 7*b* and the fixed scroll body 8*b*.

Operation fluid (refrigerant) is suctioned, from outside of the airtight vessel 2 through the suction tube 23 connected to the suctioning inlet 8*c* arranged at the airtight vessel 2, to the compression chamber Q1. The Operation fluid is then subjected to a compression process and then discharged from the discharging outlet 8*d* into the airtight vessel 2, and further discharged from a discharge pipe 24 arranged at the airtight vessel 2 to outside the airtight vessel 2.

Figure 2:
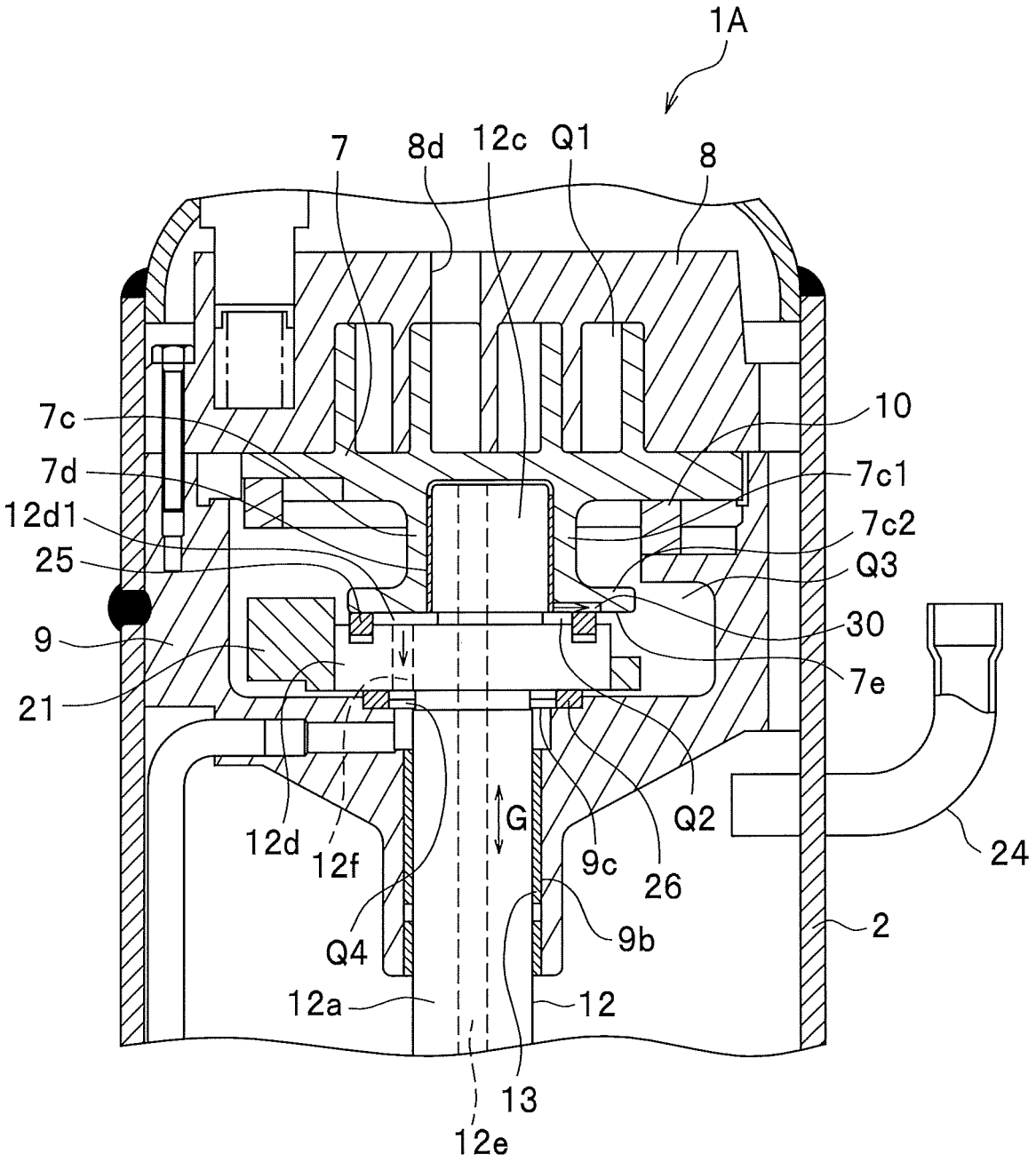
FIG. 2 is a vertical cross-sectional view of the vicinity of the frame of the scroll compressor in the first embodiment.

FIG. 2 is a vertical cross-sectional view of the vicinity of the frame of the scroll compressor in the first embodiment.

As shown in FIG. 2, the frame 9 houses, inside thereof, the revolving scroll 7, the autorotation preventing mechanism 10, the main shaft portion 12*a*, the eccentric pin portion 12*c*, the flange portion 12*d*, the balance weight 21, a sealing member 25, and a thrust bearing 26.

The sealing member 25 is arranged on the side of the upper surface 12*d*1 of the flange portion 12*d*, and seals the space between the revolving scroll 7 and the flange portion 12*d*, while sliding on the revolving scroll 7. The sealing member 25 can be any one having a sealability, and can be appropriately selected from one obtained by forming a resin member on a sliding surface (surface) of a metal base, one the entire of which is formed by a resin material, one made of metal, or the like.

The thrust bearing 26 is arranged on the lower surface of the flange portion 12*d* and on the end surface 9*c* of the frame 9, slides on the flange portion 12*d*, and supports a load acting, in the axial direction, on the crank shaft 12.

In order to improve the sealability, for the thrust bearing 26, a resin material is preferably used on the both surfaces of the sliding surface sliding on the frame 9 and the sliding surface sliding on the flange portion 12*d*. Incidentally, the whole thrust bearing 26 may be made from a resin material, or the thrust bearing 26 may be formed by arranging resin material on the upper surface and the lower surface of a metallic piece.

The space on the outer side of the sealing member 25, the space being partitioned by the above-described sealing member 25, the thrust bearing 26, the revolving scroll 7, the fixed scroll 8, the frame 9, and the flange portion 12*d*, forms a back-pressure chamber Q3. The back-pressure chamber Q3 has a pressure lower than the pressure of the high-pressure space Q2, which is a space adjacent to the crank shaft 12 and inside the sealing member 25. The back-pressure chamber Q3 optimizes the force lifting the revolving scroll 7 and increases the sealability of the compression chamber Q1, by a pressure adjusting mechanism (not shown) arranged on the fixed scroll 8 or the frame 9. A sliding surface 7*e*, which slides on the sealing member 25, of the revolving scroll 7 is provided with a throttle mechanism 30 that traverses the sealing member 25 in the radial direction by the revolution movement of the revolving scroll 7. The throttle mechanism 30 supplies oil by a differential pressure to the back-pressure chamber Q3 from the high-pressure space Q2, which is on the flange portion 12*d* side of the flange portion 12*d* and is a space adjacent to the crank shaft 12. The throttle mechanism 30 can be known means, such as a pocket groove, a slit, or the like.

The flow of oil in the scroll compressor 1A structured in such a manner is as follows. That is, by the oil supplying mechanism portion 6 (see FIG. 1) fitted to the lower end of the crank shaft 12, oil accumulated at the lower end inside the airtight vessel 2 is suctioned up through the penetration hole 12*e* inside the crank shaft 12, and is supplied to the plain bearing 7*d*. Then, a part of the suctioned-up oil flows into the high-pressure space Q2 between the annular portion 7*c*2 of the revolving scroll 7 and the upper surface 12*d*1 of the flange portion 12*d*. The oil having arrived at the high-pressure space Q2 is supplied through the throttle mechanism 30 to the back-pressure chamber Q3. The rest of the oil supplied into the high-pressure space Q2 moves through the oil passage 12*f* and arrives at the high-pressure space Q4 between the lower surface 12*d*2 of the flange portion 12*d* and the frame 9, moves in the pipe 41 to be disposed outside the frame 9, and returns to the oil accumulation 22 (see FIG. 1).

The oil supplied to the inside of the back-pressure chamber Q3 is supplied to the sliding portion between the revolving scroll 7 and the fixed scroll 8, and then discharged from the discharging outlet 8*d*. The oil discharged from the discharging outlet 8*d* moves through a gap (not shown) formed between the frame 9 and the airtight vessel 2, and discharged from the discharge pipe 24. The oil discharged from the discharging outlet 8*d* moves through gaps (not shown) formed at the frame 9, the electric motor 16, and the like to be returned to the lower end of the airtight vessel 2.

Herein, if the centrifugal force of the revolving scroll 7 is large, the deflection of the crank shaft 12 itself also becomes large. The crank shaft 12 is deflected by both the centrifugal force of the revolving scroll 7 and the centrifugal force of the balance weight 21. If the centrifugal force of the balance weight 21 can be decreased, the deflection amount can also be reduced. For example, if it is assumed that the mass of the revolving scroll 7 is m, the radius is r, and the angular velocity is ω, a centrifugal force F1 $mr\omega^2$ acts on the revolving scroll 7. Accordingly, if the distance from the rotation center of the crank shaft 12 (main shaft portion 12*a*) to the rotation center of the revolving scroll 7 is represented by L, a moment M1 that acts on the revolving scroll 7 is $mr\omega^2 \times L$. On the other hand, if it is assumed that the mass of the balance weight 21 is m', the radius is r', and the angular velocity is ω, a centrifugal force F2 of $m'r'\omega^2$ acts on the balance weight 21. Accordingly, if the distance from the rotation center of the crank shaft 12 (main shaft portion 12*a*) to the rotation center of the balance weight 21 is represented by L', a moment M2 that acts on the balance weight 21 is $m'r'\omega^2 \times L'$. In other words, if the distance L' can be made small, the mass m' of the balance weight 21 can be made small (reduction in weight), and the centrifugal force of the balance weight 21 can be made small.

In this situation, on the scroll compressor 1A in the first embodiment, by housing the balance weight 21 in the frame 9 and fitting it to the flange portion 12*d*, it is possible to make the balance weight 21 closer to the axial direction G of the crank shaft 12, which attains reduction in weight of the balance weight 21. In such a manner, by reducing the weight of the balance weight 21, the deflection of the crank shaft 12 can be reduced so that the performance of the scroll compressor 1A can be improved.

Incidentally, in general, a balance weight is a body separated from the crank shaft 12, and fitted to the crank shaft 12 by press fitting or the like. Consequently, it is difficult to attach a balance weight to the crank shaft 12 with high precision of perpendicularity to the axial direction of the crank shaft 12. Further, in a conventional art, the upper surface of a balance weight slides with a revolving scroll with each other through a thrust bearing. Accordingly, if the balance weight inclines with respect to the crank shaft, the revolving scroll also inclines with respect to the crank shaft. As the revolving scroll and the crank shaft are engaged by a plain bearing (revolution bearing), such an inclination sometimes causes a contact between surfaces only on one side, resulting in a decrease in the reliability of the scroll compressor. Further, a balance weight is, in general, usually produced by a sinter process with a mold, which makes the surface roughness of a sintered product coarse. Accordingly, for sealing by a thrust bearing, it is necessary to finish the both of the upper and lower sliding surfaces of a balance weight, by machining additionally after a sinter process. Further, in most cases, a thrust bearing is provided with a rotation stopper portion (not shown) that is fixed to one component, and a material with excellent slidability is used for the sliding surface sliding on another component. In such a case, the sealability of the surface in contact with the fixed component decreases, which makes it impossible to ensure sealability between the back-pressure chamber and the space adjacent to the crank shaft.

In this situation, in the first embodiment, by structuring a seal portion with the sealing member 25 and the thrust bearing 26, the sealability between high-pressure spaces Q2 and Q4, which are respectively on the inside of the sealing member 25 and the thrust bearing 26 (the inside along the radial direction), and the back-pressure chamber Q3, which is on the outside of them (outside in the radial direction), is improved so that the back-pressure chamber Q3 where the balance weight 21 is disposed can be made a space with little oil. In such a manner, it is possible to decrease the oil agitation loss caused by the rotation of the balance weight 21, and improve the performance of the scroll compressor 1A. Incidentally, as the load of the crank shaft 12 acts downward in the axial direction G, it is not necessary to actively receive the load by the upper surface 12*d*1 side of the flange portion 12*d*, and it is not necessary to provide the thrust bearing 26 on nor under the flange portion 12*d*.

Further, the oil supplying mechanism portion 6 (see FIG. 1) is provided with the throttle mechanism 30 that adjusts (limits) the oil supply amount supplied from the high-pressure space Q2 to the back-pressure chamber Q3. The throttle mechanism 30 is formed, for example, on the surface where the sealing member 25 and the revolving scroll 7 (annular portion 7*c*2) face each other, by a groove in a slit shape that extends and straddles the sealing member 25 in the radial direction. Thus, it is possible to prevent shortage of oil supply to the back-pressure chamber Q3, and prevent increase of friction force and burning on the sliding surface between the revolving scroll 7 and the fixed scroll 8.

Further, in the first embodiment, the flange portion 12*d* is provided with the oil passage 12*f* penetrating through the flange portion 12*d* in the axial direction G, on the inner diameter side of the sealing member 25 and on the inner diameter side of the thrust bearing 26. In such a manner, by providing the oil passage 12*f*, it is possible to prevent excessive oil flows from the high-pressure space Q2 into the back-pressure chamber Q3.

Second Embodiment

Figure 3:
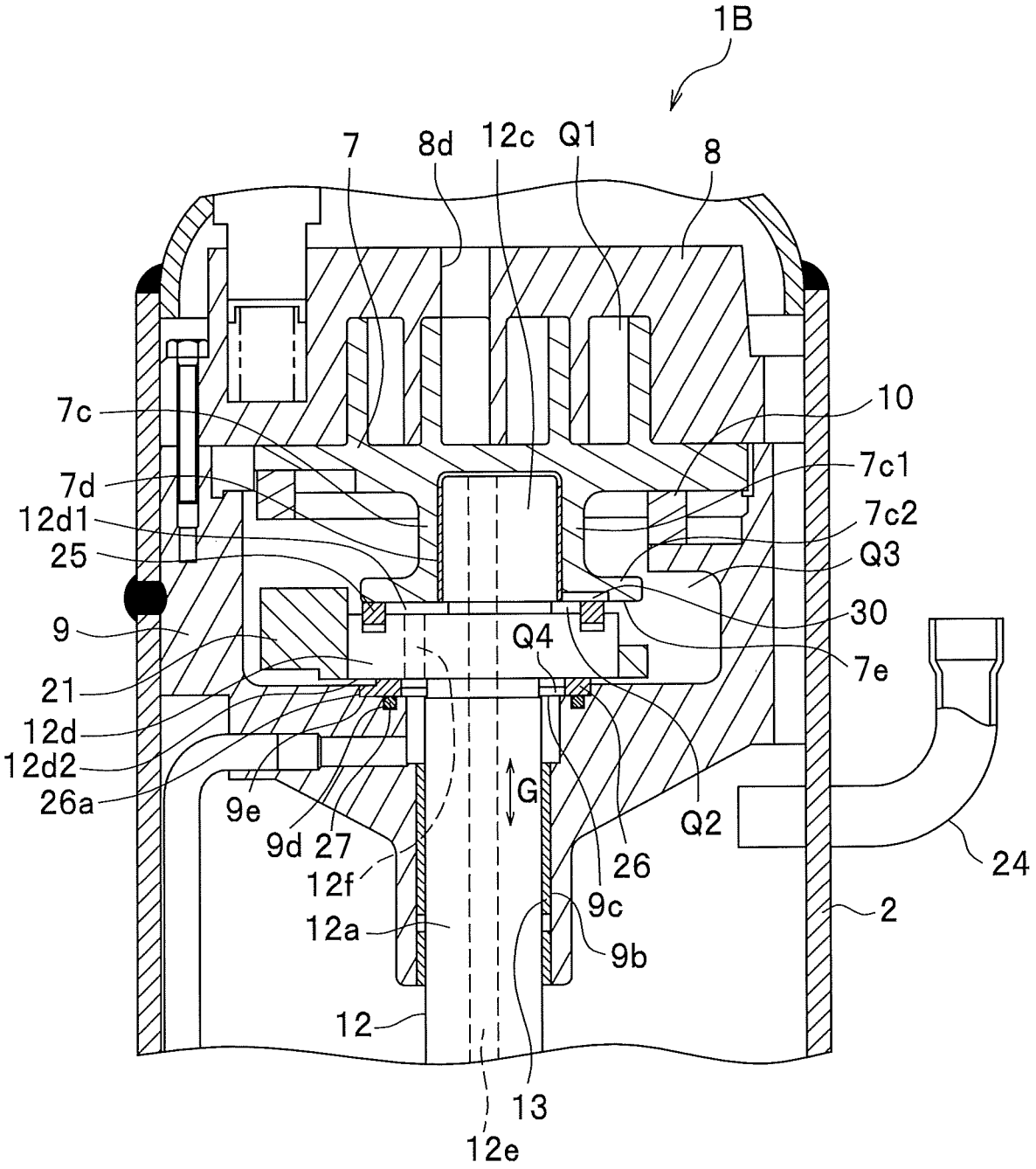
FIG. 3 is a vertical cross-sectional view of the vicinity of a frame of a scroll compressor in a second embodiment.

FIG. 3 is a vertical cross-sectional view of the vicinity of a frame of a scroll compressor in a second embodiment. Incidentally, to elements similar to those in the first embodiment, the same symbols are given, and overlapping description will be omitted (likewise also in embodiments from a third embodiment and after). Further, in FIG. 3, portions, not shown, are similar to those in the first embodiment (likewise also in embodiments from a third embodiment and after).

As shown in FIG. 3, a scroll compressor 1B in the second embodiment is one structured by adding a sealing member 27 to the scroll compressor 1A in the first embodiment. The sealing member 27 is formed by an O-ring or the like, and is housed in an annular groove 9*d* which is formed such as to face the lower surface of a thrust bearing 26 in a frame 9.

Further, the thrust bearing 26 is provided with a rotation prevention protrusion 26*a* for preventing rotation, and the frame 9 is provided with a recessed portion 9*e* with which the rotation stop protrusion 26*a* engages. Consequently, when a crank shaft 12 (flange portion 12*d*) rotates, the thrust bearing 26 is prevented from sliding and rotating with respect to the flange portion 12*d* with each other.

In such a manner, by providing the rotation preventing protrusion 26*a* to the thrust bearing 26 to thereby obtain a structure that prevents the thrust bearing 26 from sliding on the frame 9 and the sealing member 27, and it is thereby possible to use an inexpensive component such as an O-ring for a static seal. Further, adopting the above-described structure, the sealability between the frame 9 and the lower surface 12*d*2 of the flange portion 12*d* can be improved, compared with the first embodiment. Incidentally, other effects are the same as those in the first embodiment.

Incidentally, although, in the second embodiment, a case of providing the rotation preventing protrusion 26*a* to the thrust bearing 26 was described as an example, it is also possible, in contrast, to provide a rotation preventing protrusion to the frame 9, and provide the thrust bearing 26 with a recessed portion for recession-protrusion engagement with the rotation preventing protrusion.

FIG. 3 Embodiment

Figure 4:
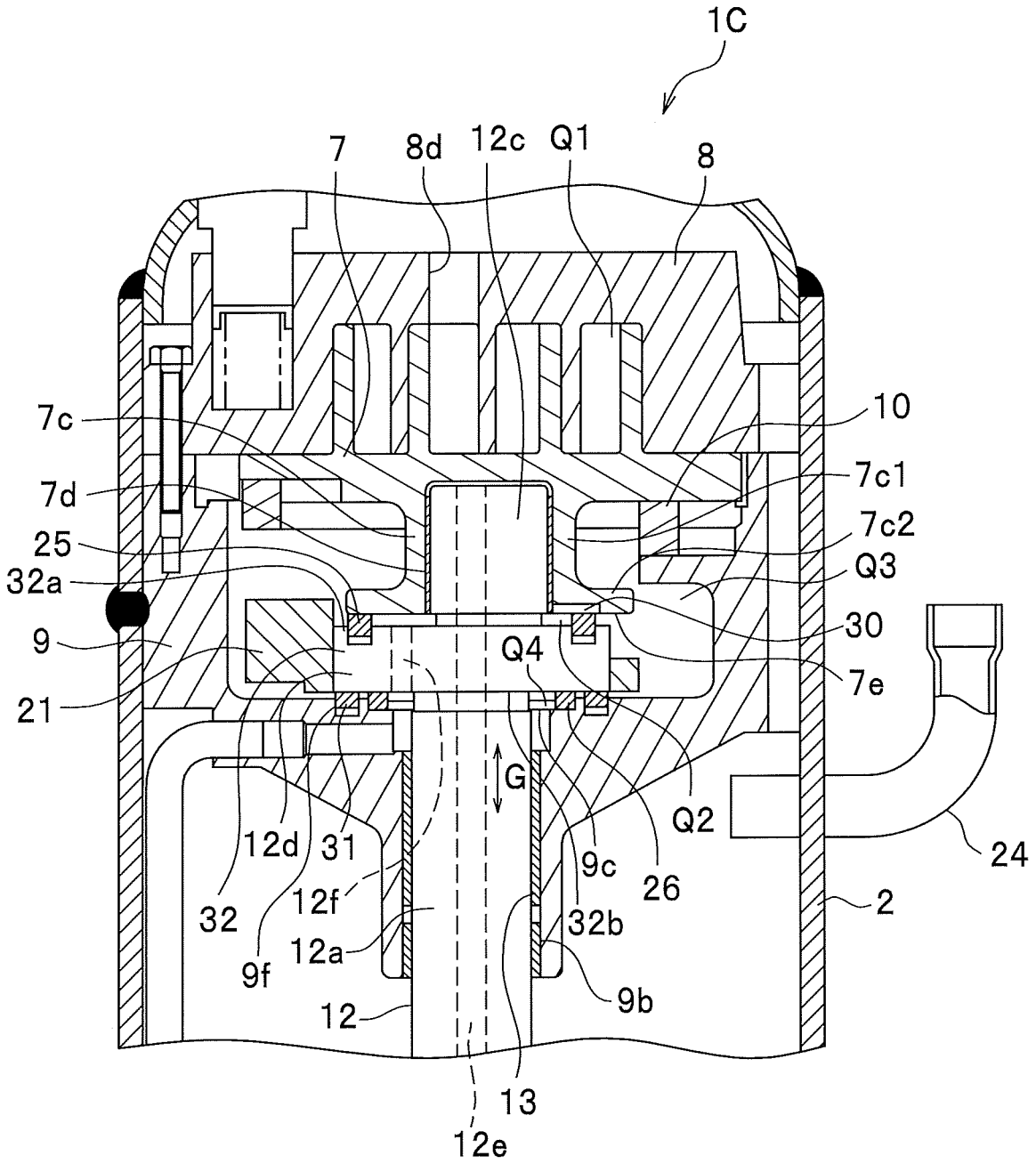
FIG. 4 is a vertical cross-sectional view of the vicinity of a frame of a scroll compressor in a third embodiment.

FIG. 4 is a vertical cross-sectional view of the vicinity of a frame of a scroll compressor in a third embodiment.

As shown in FIG. 4, the scroll compressor 1C in the third embodiment is one structured by adding a second sealing member 31 to the scroll compressor 1A in the first embodiment. The second sealing member 31 is provided between the flange portion 12*d* and the frame 9, and on the outer diameter side of the thrust bearing 26. Incidentally, the member represented by symbol 25 is a first sealing member, which is structured similarly to the first sealing member 25 in the first embodiment. The second sealing member 31 can be any one that has sealability similarly to the first sealing member 25, and can be appropriately selected from one obtained by laminating a resin material on a sliding surface (surface) of a metal material, one that is entirely made from resin material, one that is entirely made from metal, and so on.

In the scroll compressor 1C, the frame 9 houses therein a revolving scroll 7, a autorotation preventing mechanism 10, a main shaft portion 12*a*, an eccentric pin portion 12*c*, a flange portion 12*d*, a balance weight 21, the first sealing member 25, the second sealing member 31, and a thrust bearing 26. Herein, a portion formed by the flange portion 12*d* and the balance weight 21 corresponds to an outer circumferential protruding portion 32 of the crank shaft 12.

The first sealing member 25 is mounted on the upper surface side 32*a* of the outer circumferential protruding portion 32 so that the first sealing member 25 seals between the revolving scroll 7 and the outer circumferential protruding portion 32, while sliding on the revolving scroll 7.

The second sealing member 31 is mounted on the lower surface side 32*b* of the outer circumferential protruding portion 32 so that the second sealing member 31 seals between the outer circumferential protruding portion 32 and the frame 9, while sliding on either the outer circumferential protruding portion 32 or the frame 9. In the third embodiment, the second sealing member 31 is arranged on an annular groove 9*f* provided on the frame 9.

Further, the second sealing member 31 is arranged such as to be slightly movable in the axial direction G when the flange portion 12*d* and the thrust bearing 26 contact with each other. Thus, when the flange portion 12*d* and the thrust bearing 26 contact with each other, it is possible to support the load in the axial direction G by the thrust bearing 26 only, without allowing the load in the axial direction G of the crank shaft 12 to act on the second sealing member 31. Accordingly, abrasion of the second sealing member 31 can be reduced.

The second sealing member 31 is arranged on the outer diameter side (the outside in the radial direction) of the thrust bearing 26. The second sealing member 31 is disposed on the flange portion 12*d* side of the outer circumferential protruding portion 32.

In the scroll compressor 1C with such a structure, a space, which is partitioned by the first sealing member 25, the second sealing member 31, the revolving scroll 7, the frame 9, the fixed scroll 8, and the outer circumferential protruding portion 32, the space being located on the outer side of the first sealing member 25 and the second sealing member 31, is the back-pressure chamber Q3. The back-pressure chamber Q3 has a pressure lower than the pressure of the high-pressure space Q2, Q4, which are spaces adjacent to the crank shaft 12 and inside the first sealing member 25 and the second sealing member 31. A pressure adjusting mechanism (not shown) arranged on the 25 and the second sealing member 31. A pressure adjusting mechanism (not shown) arranged on the fixed scroll 8 or the frame 9 optimizes the force lifting the revolving scroll and increases the sealability of the compression chamber Q1.

The sliding surface 7*e*, of the revolving scroll 7, sliding on the first sealing member 25 is provided with a throttle mechanism 30 (a pocket groove, a slit, or the like) that traverses the sealing member 25 in the radial direction by the revolution movement of the revolving scroll 7 to supply oil, by a differential pressure, from the high-pressure space Q2, which is at the upper portion of the outer circumferential protruding portion 32, to the back-pressure chamber Q3. The outer circumferential protruding portion 32 is provided with an oil passage 12*f* penetrating through the outer circumferential protruding portion 32 in the axial direction G.

Oil having been supplied to oil accumulation 22 (see FIG. 1) by the oil supplying mechanism portion 6 (see FIG. 1) is supplied through a penetration hole 12*e* of the crank shaft 12 to a plain bearing 7*d*, and then arrives at the upper portion of an outer circumferential protruding portion 32. The oil having arrived at the upper portion of the outer circumferential protruding portion 32 is partially supplied through the throttle mechanism 30 to the back-pressure chamber Q3, and the rest arrives, through an oil passage 12*f*, at the lower portion of the outer circumferential protruding portion 32, gets disposed outside the frame 9 to be returned to the oil accumulation 22.

In the third embodiment with such a structure, a balance weight 21 is housed in the frame 9, and the balance weight 21 is mounted on the flange portion 12*d* adjacent to the revolving scroll 7. It is thereby possible to reduce the weight of the balance weight 21, reduce the deflection of the crank shaft 12, and thus improve the reliability of the scroll compressor 1C.

Further, in the third embodiment, by providing the first sealing member 25 and the second sealing member 31, the back-pressure chamber Q3, to which the balance weight 21 is fitted, is made a space with little oil. Thus, it is possible to decrease the oil agitation loss caused by rotation of the balance weight 21, and the performance of the scroll compressor 1C can be improved.

Still further, in the third embodiment, by providing the oil passage 12*f*, which penetrates in the axial direction G, on the inner diameter side (inner side in the radial direction) of the first sealing member 25 and on the inner diameter side of the second sealing member 31 and the thrust bearing 26, it is possible to prevent excessive oil flow from the high-pressure space Q2 and high-pressure space Q4 into the back-pressure chamber Q3. Yet, further, in the third embodiment, as the thrust bearing 26 is disposed on the inner diameter side (high-pressure space Q2 side) of the second sealing member 31, oil supply shortage can be prevented.

Fourth Embodiment

Figure 5:
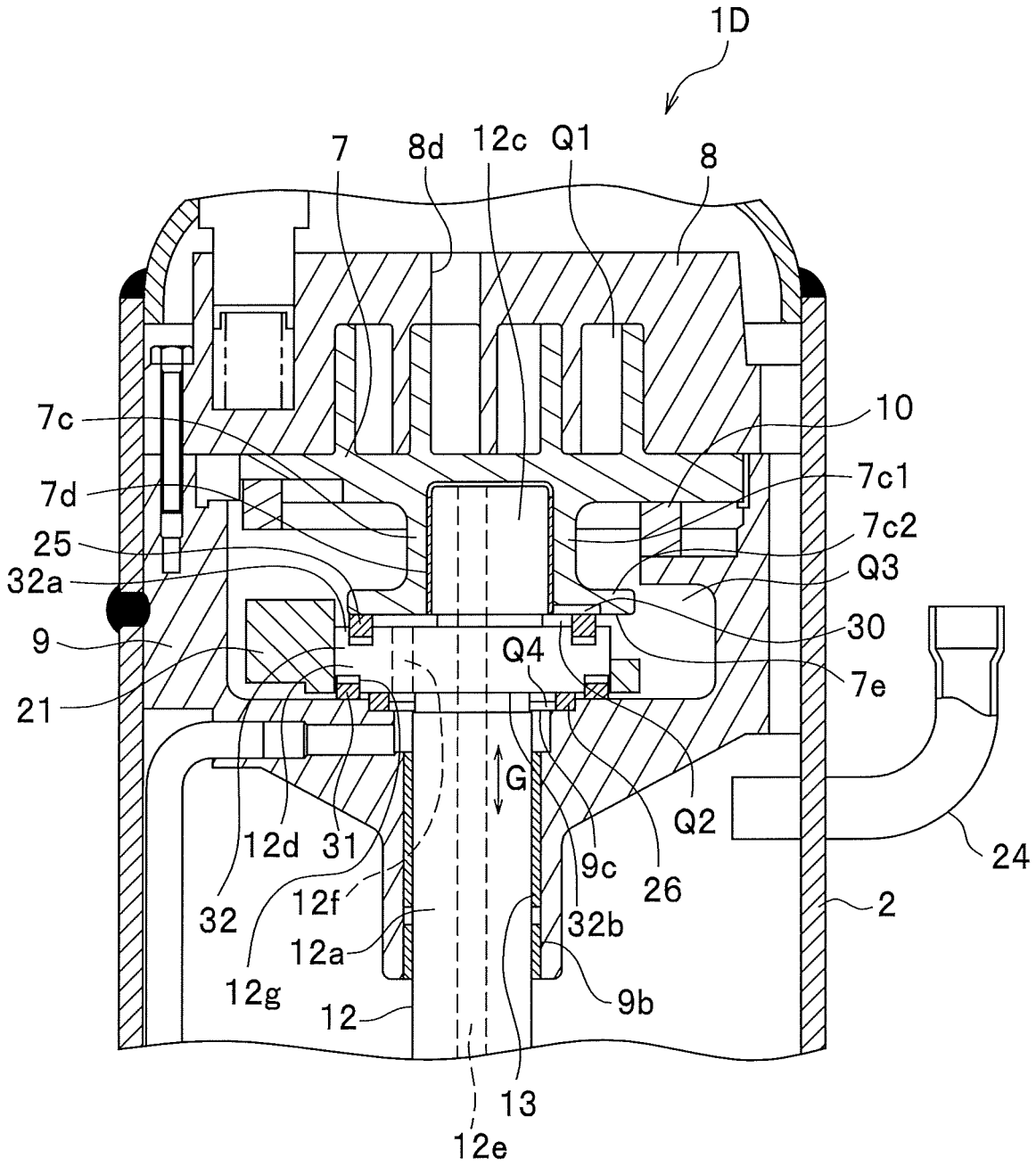
FIG. 5 is a vertical cross-sectional view of the vicinity of a frame of a scroll compressor in a fourth embodiment.

FIG. 5 is a vertical cross-sectional view of the vicinity of a frame of a scroll compressor in a fourth embodiment.

Instead of the structure in a third embodiment, where the second sealing member 31 is provided on the annular groove 9*f* formed on the frame 9 side, in a scroll compressor 1D in the fourth embodiment, as shown in FIG. 5, a second sealing member 31 is provided on an annular groove 12*g* formed on the flange portion 12*d*. With this structure, effects similar to those in the third embodiment can be obtained,

Fifth Embodiment

Figure 6:
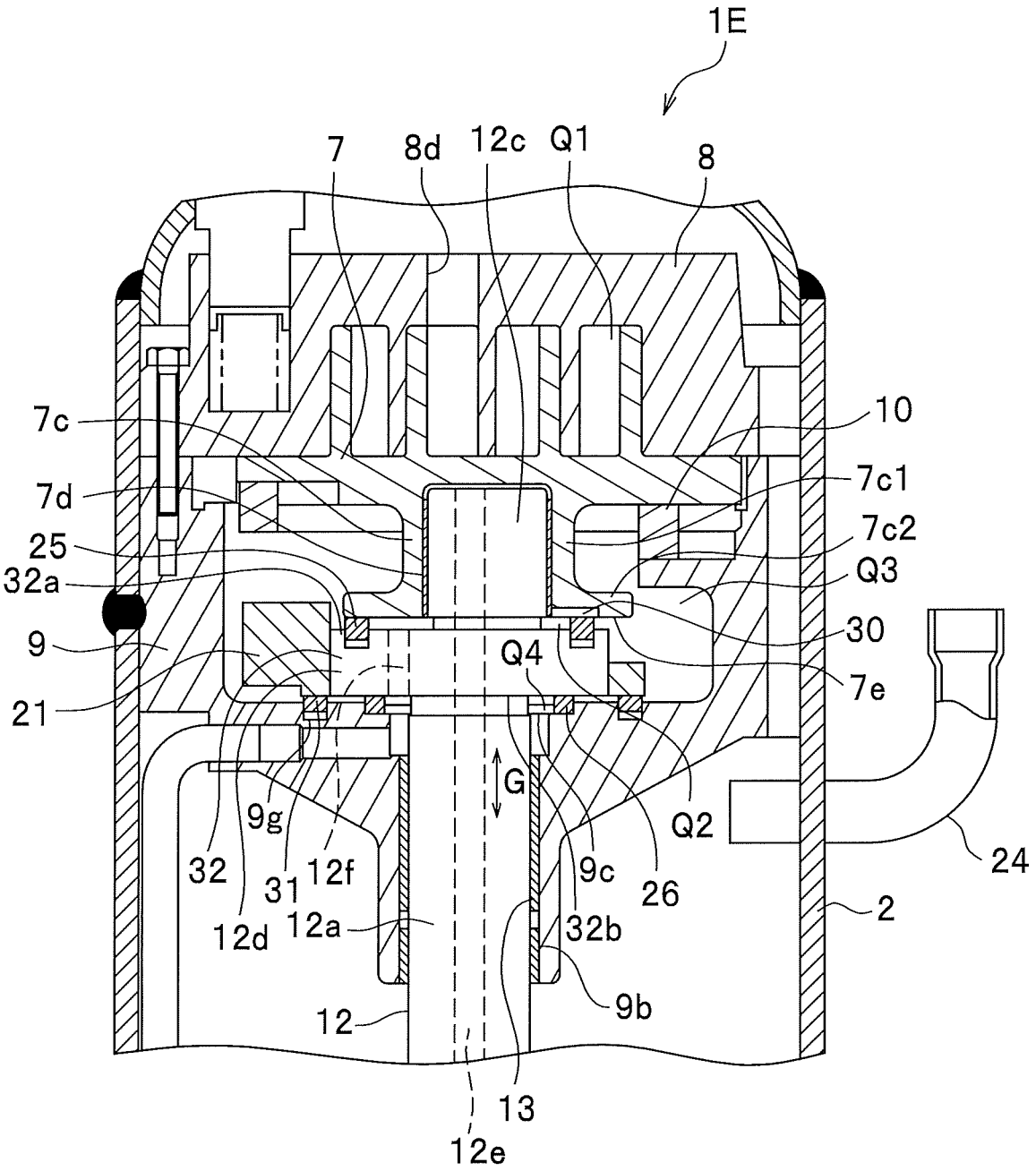
FIG. 6 is a vertical cross-sectional view of the vicinity of a frame of a scroll compressor in a fifth embodiment.

FIG. 6 is a vertical cross-sectional view of the vicinity of a frame of a scroll compressor in a fifth embodiment.

Instead of the structure, in the third embodiment, where the second sealing member 31 is provided between the frame 9 and the flange portion 12*d* (crank shaft 12), in the fifth embodiment, as shown in FIG. 6, a second sealing member 31 is provided between the frame 9 and the balance weight 21.

The frame 9 is provided with an annular groove 9*g* to which the second sealing member 31 is fitted, at a position facing the lower surface of the balance weight 21. Incidentally, an annular groove to which the second sealing member 31 is fitted may be arranged on the balance weight 21 side.

Incidentally, the balance weight 21 is in a body separated from the flange portion 12*d*, and it is difficult to obtain a perpendicularity between the balance weight 21 and the crank shaft 12. Further, the balance weight 21 is, in general, usually produced by a sinter process with a mold, which makes the surface roughness of the sintered product coarse. In this situation, by arranging the second sealing member 31 between the balance weight 21 and the frame 9, it is possible to make the second sealing member 31 follow the inclination of the balance weight 21 and the deformation of the balance weight 21 to thereby ensure sealability, and prevent excessive flow of oil from the high-pressure spaces Q2 and Q4 into the back-pressure chamber Q3.

Sixth Embodiment

Figure 7:
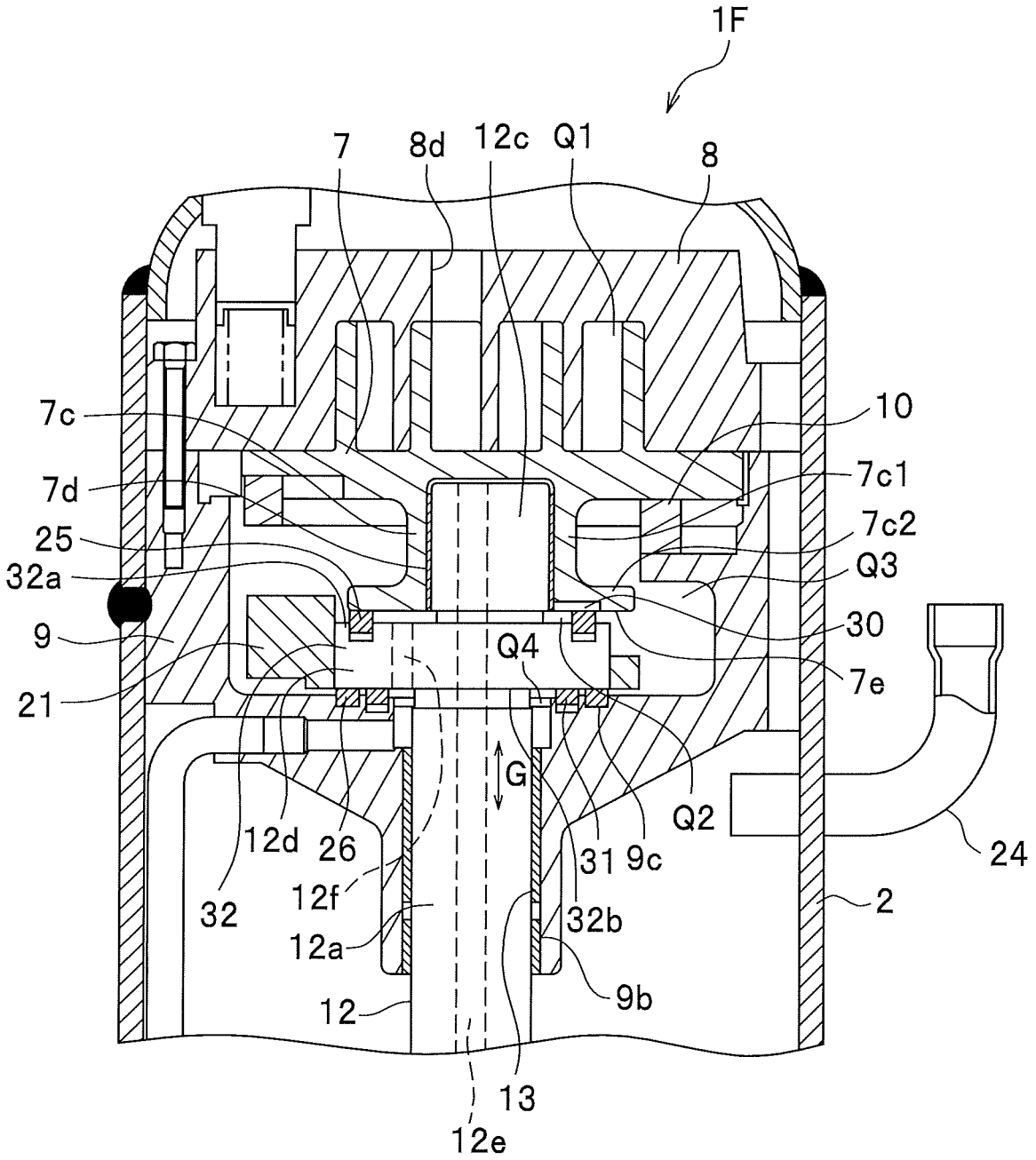
FIG. 7 is a vertical cross-sectional view of the vicinity of a frame of a scroll compressor in a sixth embodiment.

FIG. 7 is a vertical cross-sectional view of the vicinity of a frame of a scroll compressor in a sixth embodiment.

Instead of the structure, in the third embodiment, where the second sealing member 31 is provided on the outer diameter side (the outside in the radial direction) of the thrust bearing 26, in the sixth embodiment, as shown in FIG. 7, a second sealing member 31 is provided on the inner diameter side (inside in the radial direction) of the thrust bearing 26.

Further, the flange portion 12*d* is provided with the oil passage 12*f* on the inner diameter side of the sealing member 25 and the inner diameter side of the second sealing member 31 and the thrust bearing 26.

In the sixth embodiment with such a structure, by providing the thrust bearing 26 on the outer diameter side of the second sealing member 31, the thrust bearing 26 can be supported on the outer circumferential side of the flange portion 12*d*, and the crank shaft 12 can be stably supported.

The present invention is not limited to the above-described embodiments, and can be variously modified and changed within a scope without departing from the spirit of the invention. For example, in any of the first to sixth embodiments, cases, where the flange portion 12*d* as the outer circumferential protruding portion 32 and the balance weight 21 are separately structured. were described as examples, however, the flange portion 12*d* and the balance weight 21 may be integrally structured. Incidentally, an integral structure refers to a structure where the crank shaft 12 is formed by cutting a single metal cylindrical material (ingot). Thus, it is possible to precisely form the perpendicularity between the crank shaft 12 (main shaft portion 12*a*) and the balance weight 21.

DESCRIPTION OF REFERENCE SYMBOLS

1A, 1B, 1C, 1D, 1E, 1F . . . scroll compressor
2 . . . airtight vessel
7 . . . revolving scroll
7*a* . . . bedplate
8 . . . fixed scroll
9 . . . frame
10 . . . autorotation preventing mechanism
12 . . . crank shaft
12*c* . . . eccentric pin portion
12*d* . . . flange portion
12*f* . . . oil passage
13 . . . main bearing (bearing)
21 . . . balance weight
25 . . . sealing member, first sealing member
26 . . . thrust bearing
30 . . . throttle mechanism
31 . . . second sealing member
32 . . . outer circumferential protruding portion
G . . . axial direction
Q1 . . . compression chamber
Q2, Q4 . . . high-pressure space
Q3 . . . back-pressure chamber

The invention claimed is:

1. A scroll compressor, comprising:

a crankshaft including an eccentric pin portion eccentric from an axial center;

a revolving scroll having a scroll shape on a bedplate and connected to the eccentric pin portion;

a fixed scroll having a scroll shape that engages with the scroll shape of the revolving scroll;

an autorotation preventing mechanism that prevents the revolving scroll from autorotating;

a frame that houses the revolving scroll and the autorotation preventing mechanism, rotatably supports the crankshaft with a bearing, and fixes the fixed scroll, wherein the crankshaft includes a flange portion having a larger diameter than a diameter of the eccentric pin portion and arranged at a lower portion of the eccentric pin portion;

a balance weight that is mounted on the flange portion to cancel imbalance caused by rotational movement of the eccentric pin portion and revolution movement of the revolving scroll;

a first sealing member disposed between the revolving scroll and the flange portion that provides a seal between the revolving scroll and the flange portion; and a thrust bearing provided between the frame and the flange portion, wherein a space adjacent to the flange portion is partitioned, by the first sealing member and the thrust bearing, in a high-pressure space on an inner diameter side of the first sealing member and the thrust bearing, and a back-pressure chamber on an outer diameter side of the first sealing member and the thrust bearing, and wherein the revolving scroll includes a throttle mechanism that limits oil supply from the high-pressure space to the back-pressure chamber.

2. The scroll compressor according to claim 1, wherein the flange portion includes an oil passage that penetrates through the flange portion in an axial direction of the crankshaft, on an inner diameter side of the first sealing member and the thrust slide bearing.

3. The scroll compressor according to claim 1, wherein the thrust bearing is mounted on the frame, in a state of being prevented from rotating with respect to the frame, and wherein the scroll compressor further comprises a second sealing member disposed between the thrust bearing and the frame that provides a seal between the thrust bearing and the frame.

4. The scroll compressor according to claim 1, wherein the thrust bearing uses a resin material at a sliding portion sliding on the frame and a sliding portion sliding on the crankshaft.

5. A scroll compressor, comprising:

a crankshaft including an eccentric pin portion eccentric from an axial center;

a revolving scroll having a scroll shape on a bedplate and connected to the eccentric pin portion;

a fixed scroll having a scroll shape that engages with the scroll shape of the revolving scroll;

an autorotation preventing mechanism that prevents the revolving scroll from autorotating;

a frame that houses the revolving scroll and the autorotation preventing mechanism, rotatably supports the crankshaft with a bearing, and fixes the fixed scroll, wherein the crankshaft includes a flange portion having a larger diameter than a diameter of the eccentric pin portion and arranged at a lower portion of the eccentric pin portion;

a balance weight that is mounted on the flange portion to cancel imbalance caused by rotational movement of the eccentric pin portion and revolution movement of the revolving scroll;

a sealing member that provides sealing between the revolving scroll and the flange portion; and a thrust bearing provided between the frame and the flange portion, wherein a space adjacent to the flange portion is partitioned, by the sealing member and the thrust bearing, in a high-pressure space on an inner diameter side of the sealing member and the thrust bearing, and a back-pressure chamber on an outer diameter side of the sealing member and the thrust bearing, and wherein the revolving scroll includes a throttle mechanism that limits oil supply from the high-pressure space to the back-pressure chamber.

6. A scroll compressor, comprising:

a crankshaft including an eccentric pin portion eccentric from an axial center;

a revolving scroll having a scroll shape on a bedplate and connected to the eccentric pin portion;

a fixed scroll having a scroll shape that engages with the scroll shape of the revolving scroll;

an autorotation preventing mechanism that prevents the revolving scroll from autorotating;

a frame that houses the revolving scroll and the autorotation preventing mechanism, rotatably supports the crankshaft with a bearing, and fixes the fixed scroll, wherein the crankshaft includes a flange portion having a larger diameter than a diameter of the eccentric pin portion and arranged at a lower portion of the eccentric pin portion;

a balance weight that is mounted on the flange portion to cancel imbalance caused by rotational movement of the eccentric pin portion and revolution movement of the revolving scroll;

a sealing member that provides sealing between the revolving scroll and the flange portion; and a thrust bearing provided between the frame and the flange portion, wherein the flange portion includes an oil passage that penetrates through the flange portion in an axial direction of the crankshaft, on an inner diameter side of the sealing member and the thrust slide bearing.

* * * * *